US009371503B2

(12) United States Patent
Le Clef

(10) Patent No.: US 9,371,503 B2
(45) Date of Patent: Jun. 21, 2016

(54) OIL BEARING MATERIAL CRUSHING PROCESS

(71) Applicant: N.V. Desmet Ballestra Engineering S.A., Zaventem (BE)

(72) Inventor: Etienne Le Clef, Wezembeek-Oppem (BE)

(73) Assignee: N.V. Desmet Ballestra Engineering S.A., Zaventem (BE)

( * ) Notice: Subject to any disclaimer, the term of this patent is extended or adjusted under 35 U.S.C. 154(b) by 0 days.

(21) Appl. No.: 14/433,100

(22) PCT Filed: Oct. 16, 2013

(86) PCT No.: PCT/EP2013/071665

§ 371 (c)(1),
(2) Date: Apr. 2, 2015

(87) PCT Pub. No.: WO2014/060494

PCT Pub. Date: Apr. 24, 2014

(65) Prior Publication Data

US 2015/0240184 A1 Aug. 27, 2015

Related U.S. Application Data

(60) Provisional application No. 61/714,945, filed on Oct. 17, 2012.

(51) Int. Cl.
*C11B 1/10* (2006.01)
*C11B 1/04* (2006.01)
(Continued)

(52) U.S. Cl.
CPC . *C11B 1/108* (2013.01); *C11B 1/04* (2013.01); *C11B 1/10* (2013.01); *B02B 1/00* (2013.01); *B02B 1/08* (2013.01); *B02B 3/00* (2013.01)

(58) Field of Classification Search
None
See application file for complete search history.

(56) References Cited

U.S. PATENT DOCUMENTS 2,609,299 A * 9/1952 Singer ..... C11B 1/04 24/11
2,820,047 A * 1/1958 King ..... C11B 1/04 426/417

(Continued)

FOREIGN PATENT DOCUMENTS

EP 2062963 A2 * 5/2009 ..... C11B 1/02
WO WO 2008/120223 A2 10/2008

OTHER PUBLICATIONS

EP 2062963, Thorsten, H.., et al., Method and device for processing oilseeds in enerty efficient and environmentally friendly way, 2009, English Translation 6 pages.*

(Continued)

*Primary Examiner* — Yate K Cutliff
(74) *Attorney, Agent, or Firm* — Wegman, Hessler & Vanderburg

(57) ABSTRACT

An oil bearing vegetable material crushing process including pre-heating and pre-drying the material to generate warm, partially dried oil bearing vegetable material. The partially dried material may then be surface heated rapidly, to generate warm and dried material having a weakened and non-adhering hull. The hull may then be mechanically cracked and removed to yield dehulled oil bearing vegetable material and hull. The dehulled material may be flaked to produce flakes. The flakes may be solvent extracted to generate solvent laden oil and solvent laden meal. The solvent laden meal produced may be desolventized to generate hot, wet meal. The wet meal produced may be dried to generate a hot vapor stream. The hot vapor stream generated by drying the meal is condensed in a condenser. The warm liquid medium produced in the condenser may be used to pre-heat and/or pre-dry the oil bearing vegetable material.

10 Claims, 1 Drawing Sheet

(51) Int. Cl.

| | |
|---|---|
| *B02B 1/00* | (2006.01) |
| *B02B 1/08* | (2006.01) |
| *B02B 3/00* | (2006.01) |

(56) References Cited

U.S. PATENT DOCUMENTS

| | | | | | |
|---|---|---|---|---|---|
| 3,220,451 | A * | 11/1965 | Bollens | A23L 1/2003 | 426/482 |
| 4,211,695 | A * | 7/1980 | Oughton | C11B 1/10 | 426/656 |
| 4,523,388 | A | 6/1985 | Cuel | | |
| 4,619,053 | A * | 10/1986 | Schumacher | A23L 1/0151 | 34/173 |
| 4,681,029 | A * | 7/1987 | Bartesch | C11B 1/04 | 99/483 |
| 4,785,726 | A * | 11/1988 | Wear | C11B 1/04 | 34/259 |
| 6,723,370 | B2 * | 4/2004 | Ulrich | A23D 9/00 | 426/622 |
| 7,122,216 | B2 * | 10/2006 | Copeland | A23J 1/142 | 426/417 |
| 2002/0106431 | A1 | 8/2002 | Martel et al. | | |
| 2014/0186504 | A1 * | 7/2014 | Van Den Schrieck | A23D 9/04 | 426/417 |

OTHER PUBLICATIONS

International Search Report and Written Opinion mailed Feb. 21, 2014 for PCT/EP2013/071665 filed Oct. 16, 2013.

International Preliminary Report on Patentability mailed Apr. 30, 2015 for PCT/EP2013/071665 filed Oct. 16, 2013.

Schumacher, Heinz, "Preparation of Soybeans Prior to Solvent Extraction", Proceedings of the World Congress on Vegetable Protein Utilization in Human Foods and Animal Feedstuffs, Kraft, Inc., pp. 37-40, Oct. 26, 1989.

Demonstration of a Closed Circuit System Resulting in Substantial Odour Emission Reduction and Energy Saving During Oilseed Pressing, LIFE04 ENV/D/000051 Odour Scrubber, Controlling Odorous Emissions, Cargill GmbH, 2 pages, Dec. 2003-Dec. 2006.

LIFE04 ENV/D/051—Odour Scrubber, Laymen's Report, Cargill GmbH, Mainz, Germany, five pages, Jul. 5, 2007.

Odour Scrubber—Demonstration of a Closed Circuit System Resulting in Substantial Odour Emission Reduction and Energy Saving During Oilseed Pressing, LIFE04 ENV/D/000051, Cargill GmbH, Mainz, Germany, five pages, 2007.

* cited by examiner

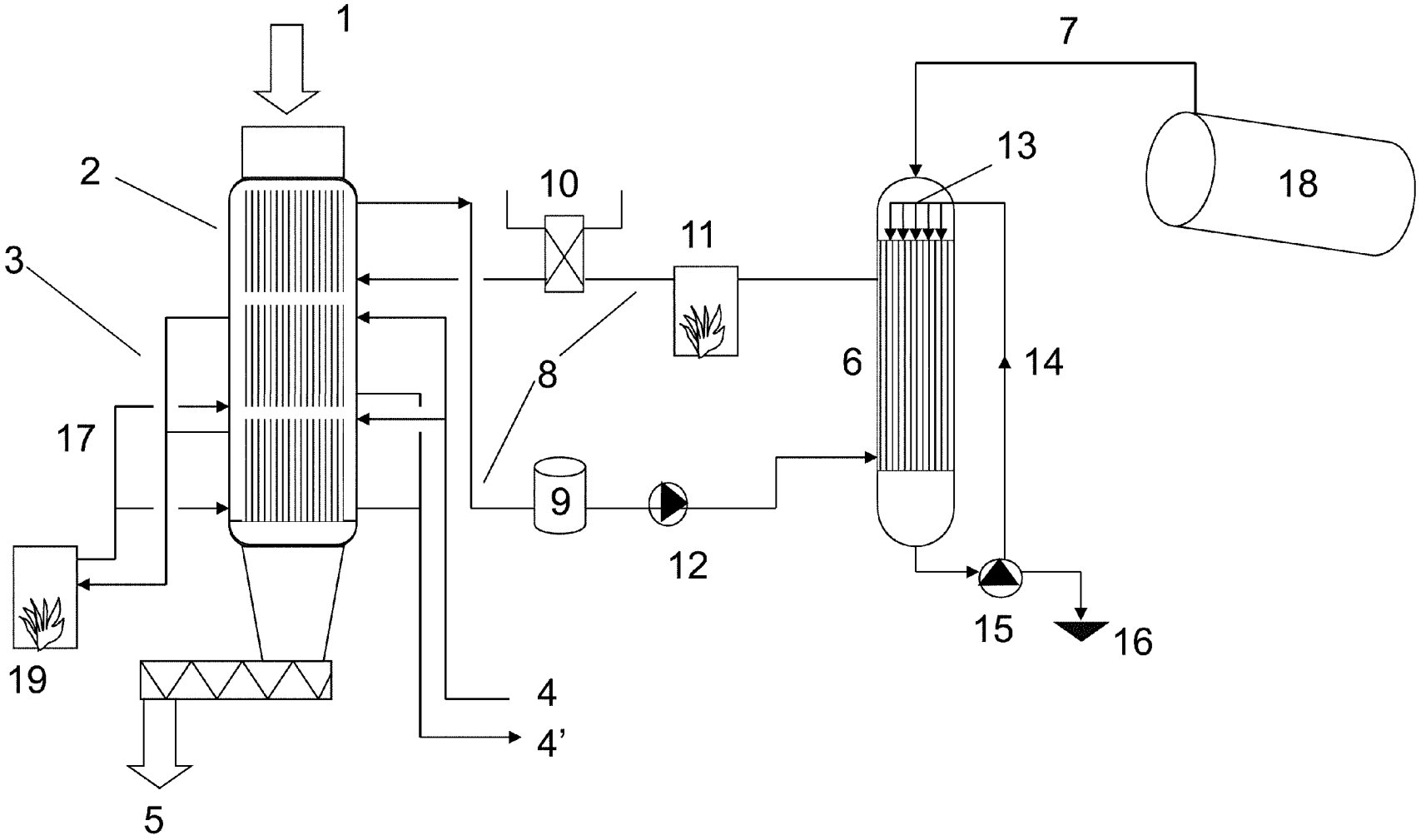
18
7
13
14
16
15
6
11
12
10
8
9
4
4'
1
2
3
17
19
5

OIL BEARING MATERIAL CRUSHING PROCESS

CROSS-REFERENCE TO RELATED APPLICATIONS

This application claims the priority benefit of International PCT Application No. PCT/EP2013/071665 filed Oct. 16, 2013 and U.S. Provisional Patent Application Ser. No. 61/714,945 filed Oct. 17, 2012.

FIELD OF THE INVENTION

This invention relates to apparatus and process related to the crushing of oil bearing vegetable material. In particular, a process and apparatus minimizing the energy requirement for soybean crushing are disclosed.

BACKGROUND OF THE INVENTION

The crushing of oil bearing vegetable material such as soybeans, rapeseeds or sunflower seeds is an energy intensive process as it involves several steps requiring mechanical and thermal energy. This energy is partially mechanical, e.g., breaking, grinding, rolling pressing and pelletizing, and partially thermal to degrade cell walls, reduce oil viscosity and adjust moisture content of any starting, intermediate or final product of the process. Before oil extraction proper, the oil bearing vegetable material must be prepared: energy must be used to rupture or weaken the walls of the oil-containing cells. For some oil bearing vegetable material, for example soybeans, a dehulling is also recommended. In the oil and fat industry, the treatments imposed to the oil bearing vegetable material before the oil extraction per se is called preparation.

The preparation preceding the oil extraction will be described in more details for soybeans which is by far the world major oil seed with a worldwide production in the range of 250 millions metric tons per year (2010, Soy Stats®, The American Soybean Association). A particularity of soybeans is that its oil and protein fractions are both of high value. Therefore, the preparation and oil extraction processes must be designed to preserve simultaneously the qualities of the extracted oil and of the remaining meal.

Soybean oil is produced predominantly by hexane solvent extraction. However, efficient hexane extraction requires a meticulous preparation of the soybeans in such a way that under normal circumstances, the solvent extraction plant can remove the oil in an efficient and economical way. One step of the preparation is the dehulling consisting in the removal of the fibrous hull surrounding the soybeans. The hull is rich in fibre and poor in oil and protein. Accordingly, the dehulling has two advantages: it reduces the amount of material that will have to be processed downstream, and it increases the protein content of the remaining meal left after the oil extraction.

Traditionally, the hull was removed by a process called now 'cold dehulling', but this process involves several thermal conditionings and long tempering to be worked out correctly. More recently, the 'hot dehulling' has been developed. In the hot dehulling, the soybeans are heated only once and tempering is eliminated. Consequently, hot dehulling is less energy demanding. This invention is concerned specifically with the hot dehulling.

Accordingly, the soybean crushing process and equipment that will be described below involves a preparation including hot dehulling, its major other steps being: cleaning, pre-heating and drying, fast surface heating, (hot dehulling), flaking and finally hexane solvent extraction.

During the cleaning step, oversized and foreign seed and/or material are removed from the soybeans. During the preheating and drying step, the soybeans are heated to typically 70-75° C. and the moisture reduction is of 2.5 to 3.0%. This step is often referred to "conditioning" in the industry. Typically, the moisture content of soybeans entering the preparation process is about 13% (in weight) to fall to 10.5 to 10.0% (in weight) when leaving the conditioning step. In the industry, the conditioning is realised predominantly in continuous flow deep bed dryer ("Bean heater") where multiple steam-heated oval horizontal tubes are in contact with the soybeans. During such conditioning, a portion of the soybean's moisture migrates to the surface of the bean, making the soybean "sweat". This surface moisture is then removed by hot air thus reducing the moisture content of soybeans. However, some moisture will also migrate and remain between the kernel and the hull. In the next step, the fast surface drying, the conditioned soybeans are subjected to blasts of dry hot air (150° C.) in a fluid bed heater resulting in a quick heating of the periphery of the soybean and in a sudden evaporation of the moisture accumulated between the hull and the kernel. During this sudden evaporation, steam pressure between the kernel and hull will make the hull fragile and also reduce its adhesion to the kernel which will facilitate the removal of the hull. Simultaneously, the fluid bed heater will furthermore remove typically 0.2 to 0.5% of moisture and increase the temperature of the soybeans to 80-85° C. In the hot-dehulling step, the soybeans weaken and non-adhering hulls are mechanically cracked typically in two to three pieces per soybean. The loose hulls are separated by aspiration. The resulting dehulled soybeans are mechanically flaked to yield flakes of about 0.3 mm of thickness. Said flakes are extracted in a hexane extractor to yield a full miscella containing about 25% of oil and solvent laden meal. Hexane is evaporated from the full miscella to yield oil and the solvent laden meal is desolventized, toasted, dryed and finally cooled to yield a meal having a protein content of typically 48% (in weight).

The total steam consumption for the preparation including the hot dehulling is about 100 kg/MT. This compares with a total steam consumption of about 150 kg/MT of steam for the preparation including the cold dehulling where two distinct heating steps and long tempering are needed.

However, even if reduced, the energy consumption for the preparation including the hot dehulling remains significant and in these days where energy cost is a major factor, should be reduced further. Consequently, energy recovery mechanism already in use in the preparation of oil bearing vegetable material should be investigated and improved or adapted for the preparation of soybeans. No process aiming at reducing further the energy demand during the preparation of soybeans has been described so far. However, an energy recovery solution is described but specifically for the preparation of rapeseed which is another major oil seed.

This energy recovery process is described in EU-project LIFE04 env/d/000051. In this energy recovery process, the thermal energy contained in the hot vapours leaving the rapeseed flake cooking step is recycled to preheat the rapeseed in the seed preheating step. This recovery process involves the scrubbing of the exhaust hot vapours leaving the meal drying to generate hot water which is then used to preheat the rapeseeds entering the process through the use of a conditioner made of vertical heat exchanger plates. The rapeseeds are flowing between the plates by gravity and are preheated by conductivity. This process allows indeed recovering thermal energy contained in the hot vapours leaving the flake cooking step; however, the scrubbing of those hot vapours generates warm water contaminated by fatty material and fines. Therefore, the cleaning and the maintenance of the equipment in contact with the warm water contaminated by fatty material and fines are difficult. Alternatively, the hot vapour stream(s) could be cleaned by filter media or cyclonic separation, but those methods are inefficient since they lead to a rapid clogging of the cleaning means due to the sticky nature of the contaminants created by the protein contained in the fines. In the previous example, some energy is recovered from the hot vapours leaving the rapeseed flake cooking step, but hot vapour leaving other step(s) of the process (such as the meal drying step for instance) would be also contaminated by fines and/or fatty materials due to the very nature of the processed vegetable material.

It is therefore the aim of the present invention to describe an oil bearing material crushing process and equipment to recover thermal energy contained in any hot vapour stream(s) contaminated by fatty material and/or fines and/or odoriferous components, such process and equipment incurring minimum fouling of heat transfer mechanisms to sustain continuous high efficiency with minimum cleaning or maintenance.

SUMMARY OF THE INVENTION

It has surprisingly been found that substantial energy recovery can be achieved in an oil bearing vegetable material crushing process including the steps of:

a) pre-heating and pre-drying the oil bearing vegetable material to generate warm (about 70 to 75° C.), partially dried (about 10.0 to 10.5% moisture) oil bearing vegetable material;

b) surface heating rapidly, the warm and partially dried oil bearing vegetable material of step a) to generate warm (about 75 to 80° C.) and dried (about 10.0% moisture) oil bearing vegetable material having a weakened and non-adhering hull;

c) mechanically cracking and removing the hull of the oil bearing vegetable material produced in step b), to yield dehulled oil bearing vegetable material and hull;

d) flaking the dehulled oil bearing vegetable material generated by step c) to produce flakes;

e) solvent extracting the flakes produced by step d) to generate solvent laden oil and solvent laden meal;

f) desolventizing the solvent laden meal produced by step e) to generate hot, wet meal;

g) drying the hot, wet meal produced by step f) to generate meal and a hot vapour stream;

wherein at least part of the thermal energy contained in the hot vapour stream generated by step g) is condensed in a condenser producing a condensate and a warm liquid medium, said warm liquid medium being used in step a) to pre-heat and/or pre-dry the oil bearing vegetable material. In some embodiments one or more of steps a) to g) may be omitted. The process may further include, in any combination, any one or more of the steps outlined in the following detailed description of the invention and embodiments thereof.

It has surprisingly been found that the use of a tubular condenser as said heat transfer mechanism to condense the hot vapour leaving the meal drying step of an oil bearing vegetable material crushing process allows substantial recovery of the thermal energy of said hot vapour streams without generating a problematic fouling of the heat transfer mechanism when the hot vapour contaminated with oil and/or fines and/or odoriferous components is condensed inside the tubes of said tubular condenser. Furthermore, cleaning of said tubular condenser is simple and continuous. Further benefits and advantages of the invention will become apparent in the detailed description of the invention.

BRIEF DESCRIPTION OF THE DRAWING

FIG. 1 is a representation of one embodiment of the process according to our invention.

DETAILED DESCRIPTION

The invention will be described and is particularly useful when applied to the crushing of soybeans; however, this invention is not strictly limited to this particular type of oil bearing vegetable material. Any oil bearing vegetable material requiring a conditioning (pre-heating and drying) similar to the one needed for soybeans will benefit from this invention. The process according to the invention preferably makes use of a continuous flow deep bed dryer (also called conditioner) where the soybeans are pre-heated and dried while being in contact with several banks of staked heated vertical hollow plates. In continuous flow deep bed dryers of such type, a hot liquid medium (for example hot water) is used instead of steam to pre-heat the soybeans. The hot liquid medium flows counter current to the product flow, through one or several bank(s) of vertically erected hollow, stainless steel plates (such plates are commonly referred as pillow plates). During this process, the hot liquid medium circulating in a closed loop is cooled and needs to be subsequently reheated. The soybeans flow slowly downward by gravity between the plates, in mass flow and are thereby pre-heated up to a uniform temperature. The drying section is located below the pre-heating section. This drying section is similar to the preheating section, but in addition contains means to blow hot air between the plates, preferably co-currently to the displacement of the soybeans. At the bottom of such continuous flow deep bed dryer, a discharge mechanism controls the downward flowrate of the conditioned material, in this case the pre-heated and dried soybeans through the conditioner. Continuous flow deep bed dryers of such design are manufactured for example by Solex Thermal Science Inc., (Calgary, Alberta, Canada). However, the invention is not limited to this particular supplier or to this particular type of continuous flow deep bed dryer fitted with hollow plates. Any continuous flow deep bed dryer using hot liquid medium circulating in hollow cavities of any form or size distributed in the mass of oilseed could benefit from the present invention. However, a remarkable feature of a conditioner equipped with plates instead of tubes or oval tubes is that the surface contact per volume unit can be surprisingly much higher for thin plates than for tubes. For example, for 1 $M^3$ of a typical commercial conditioner (i.e., bean heater) the heat exchange surface is about 15 $M^2$. However, 1 $M^3$ of a conditioner equipped with thin hollow plates can develop a heat exchange surface of 45 $M^2$. Consequently, due to this superior heat exchange surface, hot liquid medium can be used instead of steam. Overheating risks are also reduced. The hot liquid medium is commonly water but the present invention is not limited to this particular liquid heating medium.

According to an embodiment of the present invention, liquid heating medium of about 60 to 85° C., is produced in at least one tubular condenser condensing hot vapour produced during the meal drying process. Preferably, the hot vapour condenses inside the tubes of the condenser and the liquid heating medium circulates in the shell of the condenser where said liquid heating medium is heated and conducted to the continuous flow deep bed dryer in a closed loop. Preferably, a part of the condensate accumulating inside the tubes at the bottom of the tubular condenser is recycled at the top of the tubes via adequate pump and piping. The recycled condensate takes the incoming vapour stream to its dew point upon entry to maximize heat transfer and the water runs down the internal surface of the tubes. It has also been observed that the recycled condensate has an unexpected cleaning effect by continuously removing entrained oil and/or fines. The portion of the condensate not recycled back to the top of the tubes is drained and discarded. Typically, about 10 to 40% of the condensate is recycled to the top of the tubes, with the remaining condensate being drained; however, the invention is not limited to this particular recycling percentage range. The recycling rate must be high enough to ensure that the top of the tubes are not dry in order to avoid fouling inside the tubes of the tubular condenser. However, excessive recycling rate of the condensate is to be prevented to avoid unacceptable cooling of the liquid heating medium exiting the tubular condenser. For a large oilseed crushing installation processing 2000 tons of soybeans per day, a tubular condenser equipped with about 500 to 1000 vertical tubes of a length of about 5000 to 11000 mm and of diameter of about 20 to 50 mm is adequate to operate the process according to the invention. Preferably, the tubes are made of stainless steel. The shell of the tubular condenser is preferably equipped with baffles to increase the liquid heating medium velocity and improve the heat exchange coefficient between the tubes and the shell. Preferably, the hot vapours are introduced on the top of the tubular condenser by a fan or other means capable of providing sufficient velocity to the hot vapours to induce an additional self-cleaning effect by inhibiting the build-up of oil and/or fines fouling the inside of the tubes. Preferably, the hot vapour velocity is about 10 to 30 m/sec when entering the tubes.

According to an embodiment of the present invention, hot vapours produced during any of the steps involved in the soybean crushing process can be condensed in a similar tubular condenser to produce liquid heating medium of about 60 to 85° C. Preferably, it is more efficient to dedicate one tubular condenser for each particular step producing a hot vapour stream. Indeed, particular hot vapour temperature, concentration and contamination type may demand a tailored tubular condenser adapted to the precise characteristics of the hot vapour stream to be condensed. Nonetheless, in some circumstances, separate hot vapour streams could be combined and condensed in a single tubular condenser.

Optionally, hot air stream(s) can be combined to hot vapour stream(s) produced during any of the steps involved in soybean oil extraction process. For example, at least part of the hot air stream leaving the fluid bed heating can be combined with the hot vapour produced during the meal drying step. The hot air leaving the fluid bed heating has a temperature of typically 150° C. and contains some condensable moisture.

Preferably, the hot vapours condensed in the tubular condenser are produced during the meal drying step. Even more preferably, the meal dryer is of the rotary type. In such rotary type meal dryer, the circulation of the air drying the meal is realised in a counter flow mode (in respect to the meal flow) resulting in a very hot vapour stream highly saturated with moisture. Consequently, hot vapours exiting such rotary type dryer are dense in thermal energy.

Optionally, the soybeans moving in the lower section of the continuous flow deep bed dryer may be additionally heated by hot water and/or steam circulating in distinct plates rack. The hot water and/or steam circulation in distinct plates rack is preferably produced by a conventional boiler and this in addition to the warm water produced by the tubular condenser which is preferably used in the upper section of the continuous flow deep bed dryer. This option is especially useful during winter when incoming soybeans are cold.

Optionally, the liquid heating medium leaving the tubular condenser is further heated by circulating in one or more heat exchangers processing any hot fluids produced in any step of the crushing process. For example, such hot fluid may be hot oil. Typically the one or more heat exchangers are fitted in line on the piping carrying the liquid heating medium produced by the tubular condenser to the conditioner.

Optionally, the liquid heating medium leaving the tubular condenser is further heated by circulating in conventional heating device such as, for example, a boiler.

Tubular condenser as described in the present invention does not require frequent production downtime for cleaning, and if such cleaning is required, it can be reduced in time due to the large diameter of the tubes which can be cleaned by conventional high pressure cleaning equipment. The cleaning frequency depends on various factors such as the oilseeds origin and possible contamination by foreign material. The reduction of the cleaning frequency is an important advantage of the process according to the present invention since such cleaning involves production downtime.

However, our invention is not strictly limited to tubular condenser of the type described previously with the hot vapours condensed inside the tubes. Any condenser aiming at the recovery of the thermal energy contained in hot vapour stream(s) generated by any step of the crushing of oil bearing vegetable material and conducted to a continuous flow deep bed dryer would encompass the scope of the present invention. For example, the tubes of the condenser could be replaced by plates or by conduits of square section. Optionally, hot vapours could be condensed inside the shell of the tubular condenser instead of inside the tubes. In this last option, the shell of the tubular condenser is preferably devoid of any baffle.

The savings of the process according to the present invention are substantial despite the significant cost of that required for an adequate tubular condenser. As an example, for an installation processing 2000 tons per day of soybeans, the recovered energy in one tubular condenser condensing the hot vapour stream avoids the consumption of 20 to 30 kg of steam per ton of processed soybeans. At current heating oil value, this steam cutback translates into savings of US $300,000 to $450,000 per year.

A side benefit is that a part of the odoriferous components usually present in the hot vapour stream(s) originating from the meal dryer are condensed in the process according to the present invention and are therefore not released in the atmosphere which may lead to a reduction of the odour emitted by the oilseed crushing installations. However, as the detection threshold limit of those odoriferous components is very low, the reduction of the perceived odour is sometimes much less important than the actual reduction of the quantity of odoriferous components released to the atmosphere.

FIG. 1 is a diagram of the process according to the preferred embodiments of our invention. The soybeans stored at ambient temperature, for example in storage silos (not shown), are introduced at the top of the continuous flow deep bed dryer (1). The soybeans are preheated in the top section of the continuous flow deep bed dryer (2) by moving slowly between a first rack of hollow vertical plates heated by a liquid heating medium, for example hot water. During this preheating, the soybeans sweat. The preheated soybeans move in the bottom section(s) of the continuous flow deep bed dryer (3) where the preheated soybeans are further heated and dried by moving slowly between additional rack(s) of hollow vertical plates heated by a liquid heating medium and furthermore contacted with hot air (4) resulting in substantial drying of the soybeans while the moisture laden air is evacuated by exhausts (4'). The substantially heated and dried soybeans exit (5) the continuous flow deep bed dryer to be further processed (fast surface heating, hot dehulling, solvent extraction, desolventizing of the meal, drying of the meal). At least a part of the liquid heating medium circulating in the vertical plates is produced in the tubular condenser (6) by condensing the hot vapour (7) originating from meal dryer (18) or from other equipment generating hot vapour. At least part of the condensate produced by the tubular condenser is recycled inside the tubes (13) of said tubular condenser via adequate piping (14) and circulating pump (15). The non recycled fraction is drained and further processed (16). The liquid heating medium is conducted to the vertical plates of the preheater by adequate piping (8) including proper equipment such as expansion vessel (9) and circulating pump (12). The liquid heating medium produced by the tubular condenser (6) is optionally further heated by circulating in heat exchanger(s) (10) processing hot fluids produced in other step(s) of the oilseed crushing process such as hot oil for example. The liquid heating medium produced by the tubular condenser (6) is optionally further heated by conventional heating device (11). Optionally, steam or hot water (17) produced by conventional means (19) can serve as additional heating medium for one or more rack of vertical plates rack for example in the bottom section (3) of the continuous flow deep bed dryer. This last option may be preferred for example in winter.

The invention claimed is:

1. An oil bearing vegetable material crushing process including the steps of:

a) pre-heating and pre-drying the oil bearing vegetable material to generate warm, partially dried oil bearing vegetable material, said partially dried oil bearing material having a temperature of about 70 to 75° C. and a moisture content of about 10.0 to 10.5% moisture;

b) surface heating rapidly, the warm and partially dried oil bearing vegetable material of step a) to generate warm and dried oil bearing vegetable material having a weakened, non-adhering hull and a temperature of about 75 to 80° C. and a moisture content of about 10% moisture;

c) mechanically cracking and removing the hull of the oil bearing vegetable material produced in step b), to yield dehulled oil bearing vegetable material and hull;

d) flaking the dehulled oil bearing vegetable material generated by step c) to produce flakes;

e) solvent extracting the flakes produced by step d) to generate solvent laden oil and solvent laden meal;

f) desolventizing the solvent laden meal produced by step e) to generate hot, wet meal;

g) drying the hot, wet meal produced by step f) to generate meal and a hot vapour stream;

characterised in that at least part of the thermal energy contained in the hot vapour stream generated by step g) is condensed in tubes in shell condenser producing a condensate and a warm liquid medium having a temperature of about 60 to 85° C., said warm liquid medium being used in step a) to pre-heat and/or pre-dry the oil bearing vegetable material wherein said warm liquid medium is hot water; and h) recycling said warm liquid medium from said step (a) to said condenser and passing said warm liquid medium through the tubes of said tubes in shell condenser to remove entrained oils and fines.

2. The process according to claim 1 in which said oil bearing vegetable material is soybean.

3. The process according to claim 1 in which said hot vapour stream is condensed inside the tubes of the condenser.

4. The process according to claim 1 in which said hot vapour stream is introduced into the tubes of the condenser.

5. The process according to claim 1 in which the hot vapour stream entering the tubes of said condenser has a velocity of at least 10 m/sec.

6. The process according to claim 1 in which at least a fraction of said condensate is recycled inside the tubes of said condenser.

7. The process according to claim 6 in which said recycled condensate is introduced into the tubes of said condenser.

8. The process according to claim 1 in which supplementary hot water or steam produced by conventional heating device is used to further pre-heat and/or pre-dry the oil bearing vegetable material of step a).

9. The process according to claim 1 in which said warm liquid medium is further heated by one or more heat exchanger(s) and/or by conventional heating device(s).

10. The process according to claim 1 in which the drying of the hot wet meal in step g) takes place in a rotary drier.

* * * * *